United States Patent [19]

Kennedy

[11] 4,129,873

[45] Dec. 12, 1978

[54] MAIN LOBE SIGNAL CANCELLER IN A NULL STEERING ARRAY ANTENNA

[75] Inventor: Peter D. Kennedy, Mesa, Ariz.

[73] Assignee: Motorola Inc., Schaumburg, Ill.

[21] Appl. No.: 741,922

[22] Filed: Nov. 15, 1976

[51] Int. Cl.[2] ..... H01Q 3/26

[52] U.S. Cl. ..... 343/854; 343/100 LE

[58] Field of Search ..... 343/100 LE, 854, 853

[56] References Cited

U.S. PATENT DOCUMENTS

| | | | |
|---|---|---|---|
| 3,938,154 | 2/1976 | Lewis | 343/100 LE |
| 4,010,469 | 3/1977 | Marcum | 343/100 LE |
| 4,044,359 | 8/1977 | Applebaum et al. | 343/100 LE |

*Primary Examiner*—Eli Lieberman

*Attorney, Agent, or Firm*—Eugene A. Parsons

[57] ABSTRACT

In a null steering array antenna having a main antenna characterized by a radiation pattern with a relatively narrow main lobe and a plurality of secondary antennas forming a sub-array for providing a null in the direction of an undesired signal, a null steering device is associated with each secondary antenna and coupled to receive a portion of the signal from the main antenna for producing a null at each secondary antenna in the direction of the main lobe. The plurality of null steering devices are gated or otherwise activated so as not to operate on signals which are to be nulled by the main null steering apparatus.

9 Claims, 1 Drawing Figure

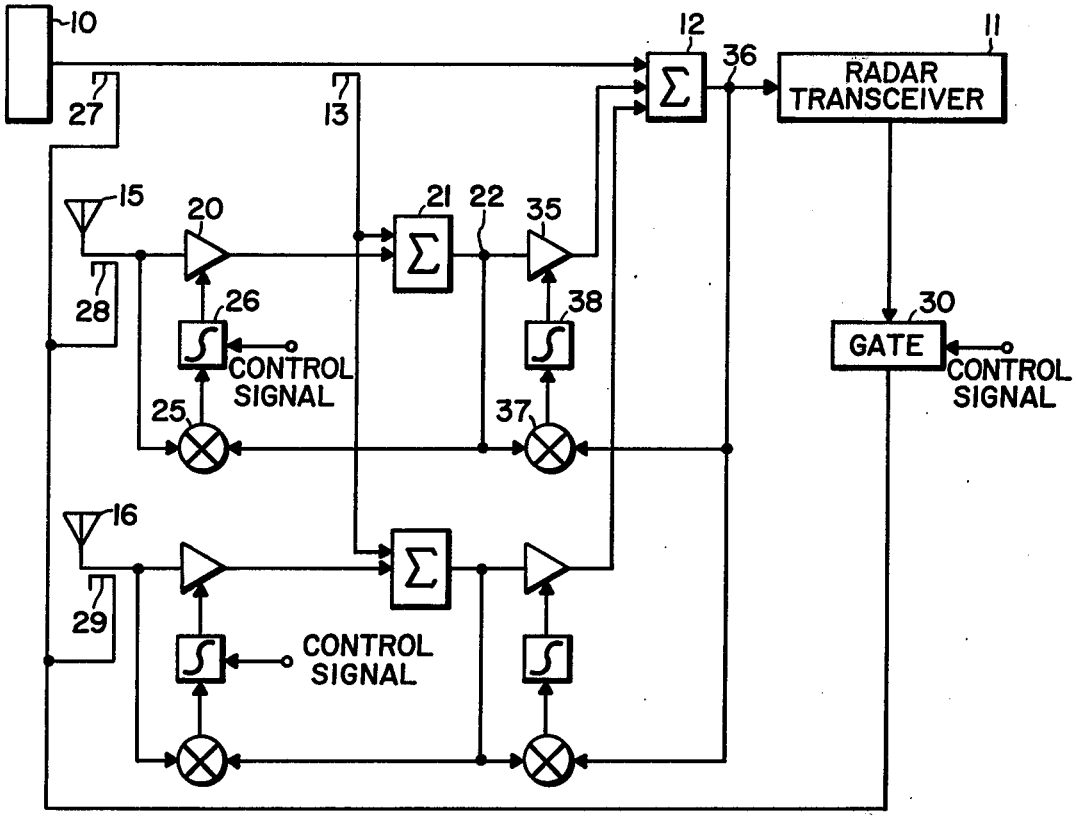
10
12
11
36
RADAR TRANSCEIVER
27
13
15
20
21
22
35
28
26
38
30
GATE
CONTROL SIGNAL
CONTROL SIGNAL
25
37
16
29
CONTROL SIGNAL

MAIN LOBE SIGNAL CANCELLER IN A NULL STEERING ARRAY ANTENNA

BACKGROUND OF THE INVENTION

Null steering is a procedure which has been known for many years and is described, for example, in such typical articles as "Adaptive Antenna Systems", by B. Widrow et al, Proceedings of the IEEE, Volume 55, No. 12, December, 1967, and "Adaptive Noise Cancelling; Principles and Applications", by B. Widrow, et al, Proceedings of the IEEE, Volume 63, Number 12, December, 1975. In one of its common forms, null steering is a technique whereby a main antenna and one or more secondary antennas are utilized, and the secondary antenna signals are weighted and summed together with the main antenna signal to form a composite antenna pattern in which undesired signals are removed. The pattern is formed in such a manner as to create antenna pattern nulls in the direction of undesired signals, such as jamming signals and the like, and the main lobe is defined by the characteristics of the main antenna. Using null steering techniques, nulls on the order of 50db can be automatically steered in the directions of jamming signals while the main lobe of the main antenna remains, theoretically, relatively unaffected.

The weighting of the secondary antenna signals to provide an output signal having the correct phase and amplitude for cancelling undesired signals in the summing device has been accomplished with a variety of null steering devices, or circuits, in the prior art. One typical null steering circuit is disclosed by P. W. Howells in U.S. Pat. No. 3,202,990, entitled "Intermediate Frequency Side-Lobe Canceller", issued Aug. 24, 1965. Somewhat different null steering circuitry for adjusting the phase and amplitude of the undesired signals is disclosed by Raymond J. Masak in U.S. Pat. No. 3,981,014, entitled "Interference Rejection System for Multi-Beam Antenna", issued Sept. 14, 1976. In U.S. Pat. No. 3,177,489, entitled "Interference Suppression Systems", issued Apr. 6, 1965, B. Saltzberg discloses a slightly different type of null steering circuit.

The main difficulty with the prior art null steering devices is that main lobe signals which reach the secondary antennas cause nulling or degrading of the main lobe signals or, in some instances, cause detrimental amplitude modulation of the main lobe signal. In many instances, the signal caused by the null steering device can have an amplitude substantially greater than the amplitude of the desired signal. Thus, it is essential that the main lobe signals, which are the desired signals for the main channel, be removed from the secondary antenna signals before the null steering apparatus operates on them.

SUMMARY OF THE INVENTION

The present invention pertains to a null steering array antenna having a main antenna characterized by a radiation pattern with a relatively narrow main lobe and a plurality of secondary antennas forming a sub-array for providing a null in the direction of an undesired signal without substantially effecting the main lobe; having a main lobe signal canceller including a first plurality of null steering means, one each connected to each of the secondary antennas and coupled to the main antenna for substantially removing the main lobe signal from the output signal of each of said null steering means; and having a second null steering means connected to said first plurality of null steering means and to the main antenna for providing a null in the direction of an undesired signal without substantially affecting the main lobe.

In addition, the present invention includes means for disabling the first plurality of null steering means when an undesired signal is present while maintaining the weighting means therein substantially at the point they were prior to disabling so that the main lobe signals are removed from the output signals of the secondary antennas but the undesired signals are substantially unaffected by the first plurality of null steering means. Thus, the second null steering means performs the function of removing the undesired signals by directing a null in the direction of the undesired signal without affecting the main lobe.

It is an object of the present invention to provide a new and improved null steering array antenna with main lobe signal cancelling means.

It is a further object of the present invention to provide a null steering array antenna including a main antenna and a plurality of secondary antennas with means for removing main lobe signals from the secondary antennas without requiring specific or peculiar positioning of the antennas in the array.

It is a further object of the present invention to provide a method of removing main lobe signals from secondary antennas in a null steering array antenna so that the main lobe signals are unaffected by the null steering techniques.

These and other objects of this invention will become apparent to those skilled in the art upon consideration of the accompanying specification, claims and drawing.

BRIEF DESCRIPTION OF THE DRAWING

The single drawing is a block diagram of a null steering array antenna with an embodiment of the present invention therein.

DESCRIPTION OF THE PREFERRED EMBODIMENT

Referring to the drawing, a main antenna, designated 10, may be any antenna required for the communications system being utilized and, in this example, is a radar antenna for a radar transceiver, designated 11. Only a connection from the antenna 10 to the receiver of the transceiver 11 is illustrated or discussed in this application since the transmissions do not form a portion of the invention. The output signals from the main antenna 10 are connected directly to a summing device 12 and a portion of the signals are coupled from the antenna 10 by a coupler 13, which may be any desired device, including a direct connection, which will provide the required signal at the output thereof.

A plurality of secondary antennas, which in this embodiment includes only two antennas, 15 and 16, for convenience of description, is associated with the main antenna 10 and may be directed in the same direction as the main antenna 10 to assure the reception of undesired signals received by the main antenna 10. Since the circuitry associated with each of the secondary antennas 15 and 16 in similar, only the circuitry associated with one of the antennas, antenna 15, will be described in detail and it will be understood that the circuitry associated with the other antenna, antenna 16, operates in a similar fashion.

Antenna 15 is connected to a first adjustable weighting device 20, which is constructed to vary the phase and amplitude of signals applied thereto in accordance with signals applied to a control input thereof, as is well known in the art of null steering systems. The adjusted signal at the output of the weighting device 20 is connected to one input of a summing device 21. A second input of the summing device 21 is connected to the coupler 13 to introduce a portion of the signal from the main antenna 10 into the summing device 21, which sums the signal from the main antenna and the adjusted signal and supplies an output signal to an output terminal 22. The signal at the terminal 22 is fed back to a mixer 25, which also receives an unadjusted signal from the antenna 15 and mixes the two signals to supply an output signal to an integrator 26. The combination of the mixer 25 and the integrator 26 form a correlating device for correlating the two signals applied to the mixer 25. The output of the integrator 26 is connected to the control input of the weighting device 20 to control the amplitude and phase of signals passing therethrough. Thus, the first feedback loop including weighting device 20, summing device 21, mixer 25 and integrator 26 compares the signal on the antenna 15 to a portion of the signal on the main antenna 10 to remove any of the main lobe signal which may appear at the antenna 15 so that the signal at the terminal 22 contains only undesired signals (that is, signals arriving from angles outside of the main lobe region of the main antenna 10) picked up by antenna 15. While a specific embodiment is illustrated for the first feedback loop, or null steering means, it should be understood that any of the prior art circuits described above might be utilized since the operation of all of these circuits and the one illustrated are basically the same.

In many instances, the first feedback loop may attempt to null out or remove the undesired signals as well as the desired signals in the main lobe of the main antenna 10. When this occurs the purpose of the first feedback loop may be defeated because the signal at terminal 22 can no longer be used to cancel such undesired signals from the output of summing device 12. To prevent the first feedback loop from responding to the undesired signals, the loop can be constructed to operate with a very long time constant so that a momentary burst of interference will have only a small effect on the weighting device 20. In such a system the weighting device 20 is maintained at the proper value by the integrating action of the loop.

A third system (illustrated in the figure) supplies a pilot signal to the main antenna 10 and each of the secondary antennas 15 and 16 through coupling devices 27, 28 and 29, respectively, which are connected through a gating device 30 to the transceiver 11. The gating device 30, the integrator 26 and the comparable integrator in the first feedback loop associated with the secondary antenna 16 are controlled, from a control signal source not shown, to enable the feedback loops only when the pilot signal is present. The pilot signals are applied to the main antenna 10 and secondary antennas 15 and 16 with the proper phase and amplitude to produce a null in the secondary antennas in the direction of the main lobe of the main antenna 10. The weighting devices in the loops are then maintained at the proper value after the loops are disabled. For example, if the null steering system is utilized with a radar transceiver 11 (as in the present disclosure, the pilot signal can be applied and the feed-back loops enabled for a short period between each radar pulse when a return signal is not being received. Further, the pilot signal is derived, for example, from the radar transmitter pulse. It should be understood, of course, that other pilot signals and methods of applying them might be utilized.

The output signal at the terminal 22, with any components of the main lobe signal from the main antenna 10 removed therefrom, is applied to a second weighting device 35. The weighting device 35 is similar to the weighting device 20 and controls the phase and amplitude of the signal applied thereto in accordance with a control signal applied to a control input thereof. The adjusted signal from the weighting device 35 is applied to a second input of the summing device 12. Similarly, the second weighting device associated with the antenna 16, and any other similar weighting devices associated with other antennas in the system supply signals to the summing device 12, which provides an output signal at a terminal 36 which is the sum of all of the signals applied thereto. The terminal 36 is connected to one input of a mixer 37, a second input of which is connected to the terminal 22. The mixer 37 correlates the two signals applied thereto in conjunction with an integrator 38, and supplies an output signal through the integrator 38 to the control input of the weighting device 35. Thus, the second feedback loop including weighting device 35, summing device 12, mixer 37 and integrator 38, compares the signals at the terminal 22 (interference signals free of main lobe signals) to the signal from the main antenna 10 to produce an output signal at the terminal 36 which is free of off-axis or interference signals. In actual operation, the correlator (mixer 37 and integrator 38) compares the signals at the terminal 22 to the signal at the terminal 36 and supplies a control signal to the weighting device 35 so that all of the signals at the terminal 22 are nulled or removed from the signal at the terminal 36 in a manner similar to that described in detail in the above referenced patents. Thus, since the signal at the terminal 22 is pure interference or off-axis signal, the signal at the terminal 36 will be only the main lobe signals or the desired signals. These signals are then applied to the receiver of the radar transceiver 11 for normal processing. It will, of course, be understood that the radar transceiver 11 is illustrative of one application of the present null steering system and many other applications in widely varying communications systems may be devised by those skilled in the art.

While I have shown and described a specific embodiment of this invention, further modifications and improvements will occur to those skilled in the art. I desire to be understood, therefore, that this invention is not limited to the particular form shown and I intend, in the appended claims, to cover all modifications which do not depart from the spirit and scope of this invention.

I claim:

1. In a null steering array antenna having a main antenna characterized by a radiation pattern with a relatively narrow main lobe and a plurality of secondary antennas forming a sub-array for providing a null in the direction of an undesired signal without substantially affecting the main lobe, a main lobe signal canceller comprising:

(a) A plurality of first feedback means one each coupled to each secondary antenna for removing the main lobe signal from the output signal thereof, each first feedback means including first adjustable weighting means for varying the phase and amplitude of signals from the associated secondary antenna and providing an output signal indicative of the varied signal, first summing means coupled to receive the output signal from said first weighting means and at least a portion of the output signal from the main antenna and provide an output signal indicative of the sum thereof, and first correlating means connected to correlate the output signal of said first summing means with the signal from the associated secondary antenna and provide an output signal coupled to said first weighting means for adjusting the phase and amplitude of the output signal thereof to remove main lobe signals therefrom; and (b) second feedback means including a plurality of second adjustable weighting means one each connected to receive the output signal from each of said first summing means for varying the phase and amplitude thereof and providing an output signal indicative of the varied signal, second summing means connected to receive the output signals from said second weighting means and the signal from the main antenna and provide an output signal indicative of the sum thereof, and a plurality of second correlating means each connected to correlate the output signal of said second summing means with the output signal of the associated first summing means and providing an output signal coupled to said associated second weighting means for adjusting the phase and amplitude of the output signal thereof to provide a null in the direction of an undesired signal.

2. A main lobe signal canceller as claimed in claim 1 wherein each of the plurality of first feedback means include means for making the time constant of the first feedback means long relative to bursts of the undesired signal.

3. A main lobe signal cancellor as claimed in claim 1 wherein each of the plurality of first feedback means include integrating means.

4. A main lobe signal canceller as claimed in claim 3 including, in addition, means for disabling the first feedback means during part of each received signal sequence and maintaining the first weighting means at substantially the setting required at the time of disabling for the remainder of the received signal sequence.

5. A main lobe signal canceller as claimed in clim 4 wherein the array antenna is utilized to receive periodic signals and the disabling means disables the first feedback means for a predetermined period between periodic signals.

6. A main lobe signal canceller as claimed in claim 4 including means for introducing a pilot signal into the array antenna during the time that the first feedback means is operative and disabling the pilot signal when the first feedback means is disabled.

7. In a null steering array antenna having a main antenna characterized by a radiation pattern with a relatively narrow main lobe and a plurality of secondary antennas forming a sub-array for providing a null in the direction of an undesired signal without substantially affecting the main lobe, a method of substantially cancelling main lobe signals comprising the steps of:

(a) providing a first plurality of adjustable weighting devices one each connected to each secondary antenna;

(b) Correlating the sum of a portion of the signal from the main antenna and the output of each first weighting device with signals on each associated secondary antenna and adjusting each first weighting devices in accordance therewith to provide a weighted signal with the main lobe signal from the secondary antennas removed therefrom;

(c) providing a second plurality of adjustable weighting devices one each coupled to receive the weighted signals; and (d) correlating the sum of the signal from the main antenna and the output of each second weighting device with each weighted signal and adjusting each second weighting device in accordance therewith to provide an output signal having the undesired signal removed therefrom.

8. A method as claimed in claim 7 having in addition the step of maintaining the first weighting devices substantially fixed at periodic intervals corresponding to periods when main lobe signals are expected.

9. A method as claimed in claim 8 having in addition the step of introducing a predetermined main lobe signal during the time that the first weighting devices are not maintained substantially fixed.

* * * * *